US005357855A

United States Patent [19]

Ishigaki et al.

[11] Patent Number: 5,357,855

[45] Date of Patent: Oct. 25, 1994

[54] SCREW PRESS FOR DEWATERING A SLURRY

[75] Inventors: Eiichi Ishigaki, Sakaide; Yukitoshi Mitani, Marugame, both of Japan

[73] Assignee: Ishigaki Mechanical Industry Co., Ltd., Japan

[21] Appl. No.: 50,449

[22] PCT Filed: Sep. 24, 1991

[86] PCT No.: PCT/JP91/01268

§ 371 Date: May 17, 1993

§ 102(e) Date: May 17, 1993

[87] PCT Pub. No.: WO93/05953

PCT Pub. Date: Apr. 1, 1993

[51] Int. Cl.[5] ..... B30B 9/14

[52] U.S. Cl. ..... 100/48; 100/112; 100/117; 100/127; 100/145

[58] Field of Search ..... 100/35, 37, 43, 48, 100/112, 117, 127, 145

[56] References Cited

U.S. PATENT DOCUMENTS

| | | | |
|---|---|---|---|
| 1,876,064 | 9/1932 | Lang | 100/112 |
| 2,419,545 | 4/1947 | Gray et al. | 100/117 X |
| 2,709,957 | 6/1955 | Armstrong | 100/117 |
| 4,286,512 | 9/1981 | Berggren | 100/112 X |
| 4,844,799 | 7/1989 | Lee | 100/112 X |

FOREIGN PATENT DOCUMENTS

| | | | |
|---|---|---|---|
| 54-12774 | 6/1979 | Japan . | |
| 60-247498 | 12/1985 | Japan . | |
| 61-9999 | 1/1986 | Japan . | |
| 3-57596 | 3/1991 | Japan . | |
| 856853 | 8/1981 | U.S.S.R. | 100/43 |
| 1369917 | 1/1988 | U.S.S.R. | 100/43 |
| 1127727 | 9/1968 | United Kingdom | 100/117 |

*Primary Examiner*—Stephen F. Gerrity
*Attorney, Agent, or Firm*—Jones & Askew

[57] ABSTRACT

A screw press for dehydrating slurry and comprising an outer screen casing, a screw shaft, a slurry supplying portion, and a driving unit which rotates the outer screen casing and the screw shaft. The driving unit rotates the screw shaft in one rotational direction and the outer screen casing in the opposite rotational direction. The driving unit comprises a transmission for changing the rotational frequency of at least one of the outer screen casings or the screw shaft. It is possible to have a high dehydrating effect by rotating the outer screen casing in the opposite rotational direction of the screw shaft at a predetermined rotational frequency.

9 Claims, 5 Drawing Sheets

SCREW PRESS FOR DEWATERING A SLURRY

FIELD OF THE INVENTION

This invention relates in general to screw presses, and relates in particular to a screw press which dehydrates slurry to produce sludge and discharges the sludge.

BACKGROUND OF THE INVENTION

A conventional screw press generally has a screw shaft mounted inside an outer screen casing. Slurry is supplied between the screw shaft and the outer screen casing. Slurry is then dehydrated and pressed by rotating the screw shaft subject the slurry to a solid-liquid separation, and the produced sludge is discharged as a cake.

When the cake is formed gradually during the dehydrating operation by the screw press, the load on a drive unit rotating the screw shaft becomes too heavy to press the slurry sufficiently.

The above mentioned outer screen casing mounted on the screen press is not capable of bearing a large pressure. This is because the outer screen casing is mainly formed from a metal screen. The screw press for dehydrating viscous waste water requires a pressure tightness in order to receive a large pressure. Therefore, the metal screen of the outer screen casing mounted on the press is rigidly reinforced by rings, flanges, and so on. The screen of the screw press processing the viscous slurry usually has a fine mesh. As a result, the screen tends to clog and then needs to be cleaned. Conventionally, although the clogged screen is cleaned with a brush, it is very difficult to clean the clogged screen to a good condition because the screen has a very fine mesh and the above mentioned reinforced flange and related structure prevent the brush contacting the entire screen. In an alternative method of cleaning the screen by spraying compressed air onto the screen, that method also is unable to thoroughly remove the clogging.

SUMMARY OF INVENTION

It is a primary object of this invention to provide a screw press which has an improved capability of dehydration and is capable of reducing an overload on a drive unit rotating a screw shaft during the dehydration, and has a screen from which the clogging of the mesh can be easily cleaned.

It is another object of this invention to provide a method for driving the screw press, comprising a first step of detecting the overload produced in a drive unit driving the screw press during processing of slurry, and a second step of returning to the slurry process again after reducing the overload, thereby performing the slurry process continuously and efficiently.

This invention is based on the discovery that the slurry process is effectively performed by rotating an outer screen casing simultaneously with the rotation of the screw shaft at a rotating speed within a predetermined range, in the opposite rotational direction of the screw shaft. The screw press of this invention is characterized by a drive unit for rotating the screw shaft in one rotational direction and for rotating the outer screen casing in the opposite rotational direction at the same time. The drive unit has a transmission which changes the rotational speed of at least one of the outer screen casing or the screw shaft.

The effectiveness of dehydration by the screw press is especially obtained by setting the rotational speed of the outer screen casing in the ratio 0.1–1.2 to that of the screw shaft. Therefore, the transmission is characterized by the capability of rotating the outer screen casing and the screw shaft in accordance with the above ratio.

The above-mentioned screw shaft is characterized by a hollow shaft having an outer screenlike surface for filtering the slurry. Therefore, the dehydration efficiency becomes higher by performing a double filtration.

The above-mentioned screw press comprises a device for detecting overload when it occurs in the drive unit, and a device for rotating at least one of the outer screen casing and the screw shaft in a rotational direction opposite to their present rotational direction for a predetermined period of time against said overload. Therefore, the load of the drive unit is reduced.

In the screw press above described, a high pressure cleaning device is disposed inside the screw shaft and on the portion adjacent to the outer surface of the outer screen casing. Therefore, it is possible to reduce the overload by cleaning the screen and the contact surfaces of the outer screen casing and the screw shaft with the cake, by using a device which injects water or a wash liquid at high pressure. The cleaning device is also used for cleaning the outer screen casing and the screw shaft after completing the dehydration.

In the method of the present invention for driving the screw press, the drive unit rotates at least one of the outer screen casing or the screw shaft in a rotational direction opposite to an initial rotational direction for a predetermined period of time. Thereafter, the drive unit returns to the initial driving condition to rotate the outer screen casing and the screw shaft in the initial rotational direction.

When overload is produced in the drive unit during the above driving method, it is possible to reduce the overload by cleaning cake from the contacting surface of the outer screen casing and the screw shaft using the high pressure cleaning device.

Other objects and advantages of the present invention will become apparent from the following description of the preferred embodiment.

DETAILED DESCRIPTION OF PREFERRED EMBODIMENT

Figure 1:
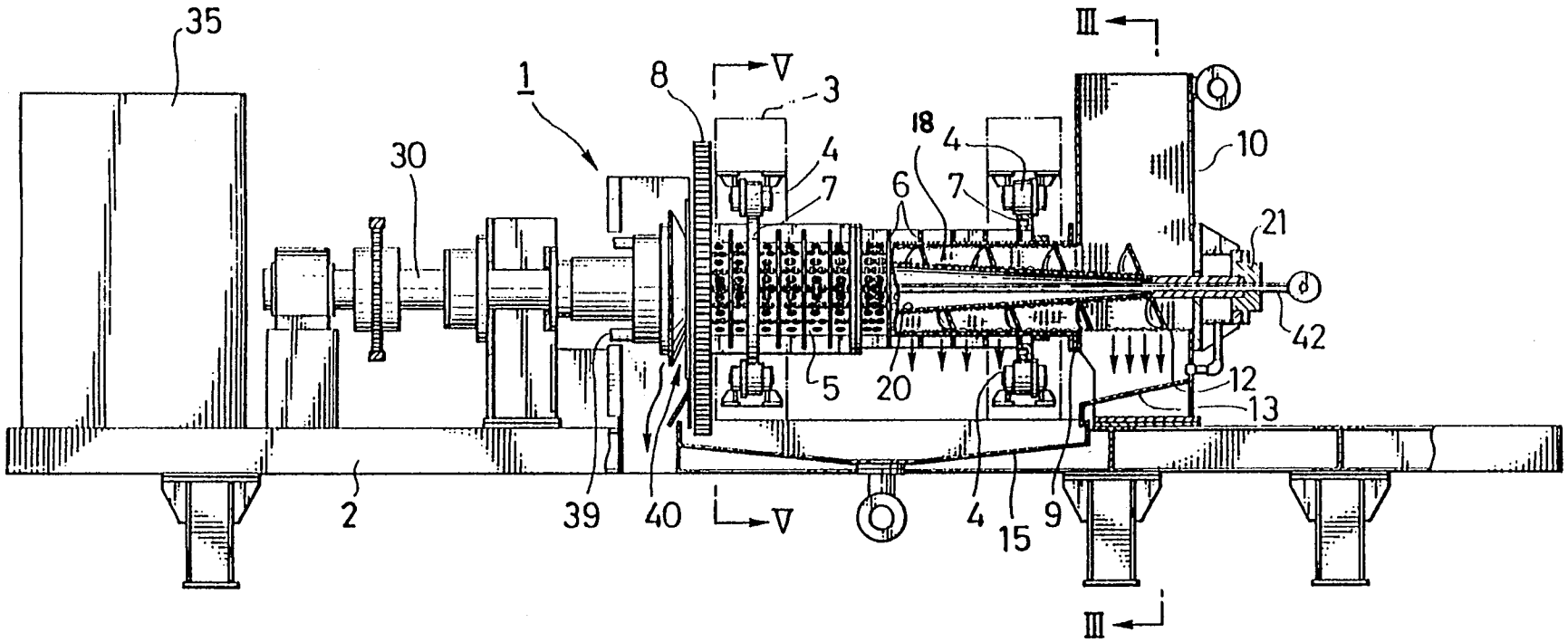
FIG. 1 is a partially sectioned side view of a screw press according to an embodiment of the present invention.
Figure 2:
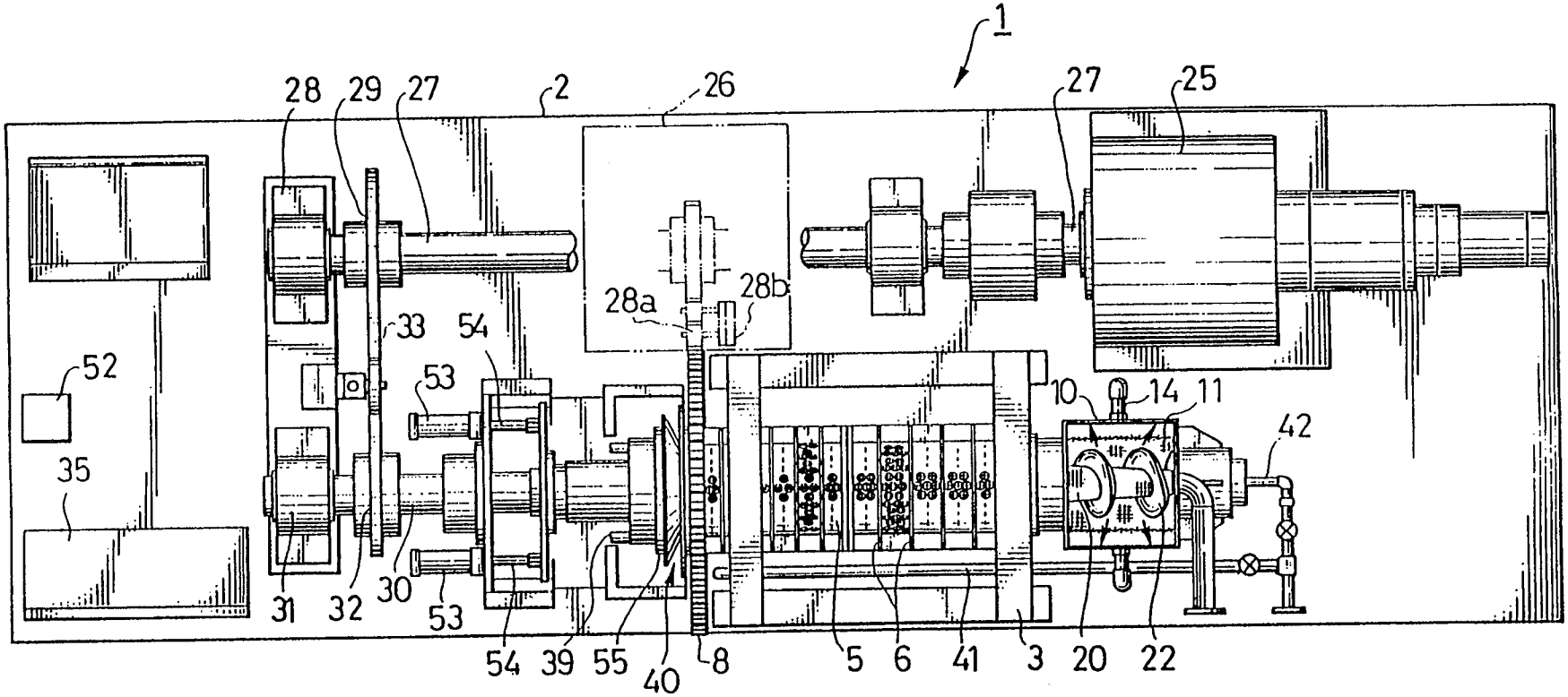
FIG. 2 is a plan view of the screw press shown in FIG. 1.
Figure 3:
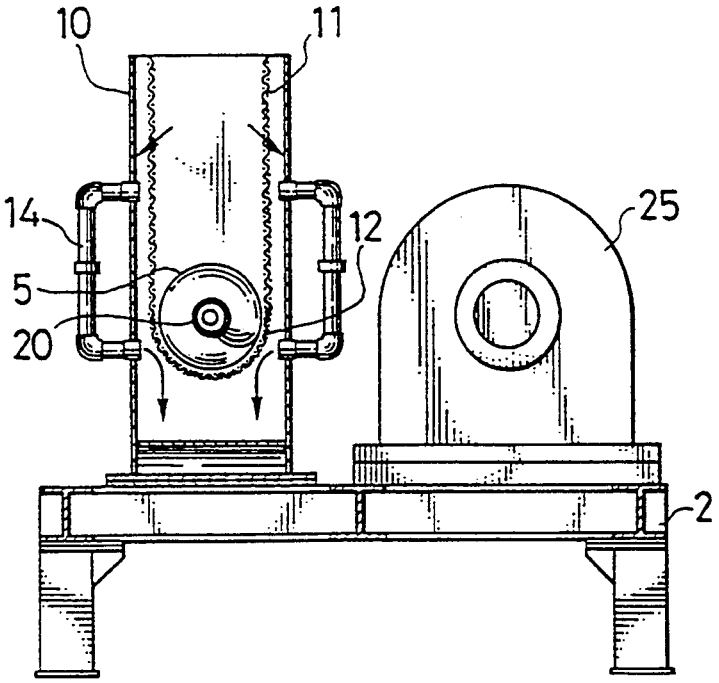
FIG. 3 is a side view of the screw press taken from the right side of FIG. 1 and shows one portion sectioned on line III—III of FIG. 1.
Figure 4:
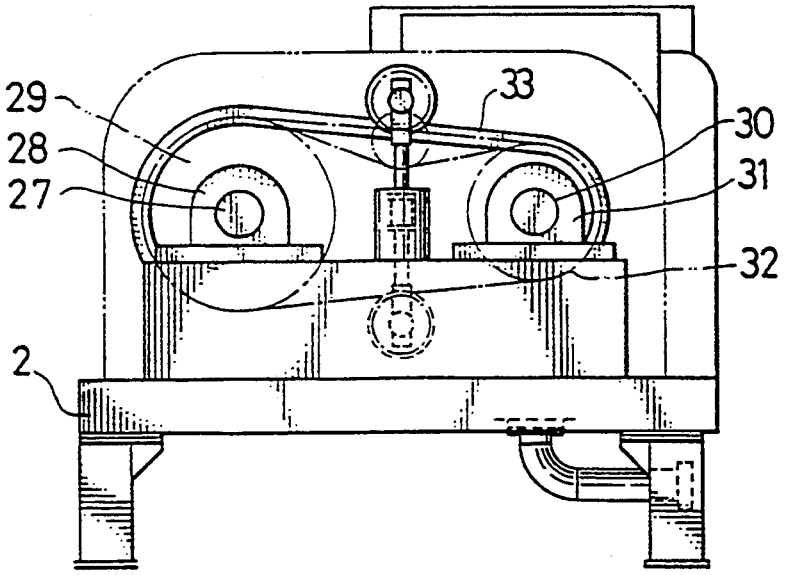
FIG. 4 is a side view of the screw press taken from the left side of FIG. 1.
Figure 5:
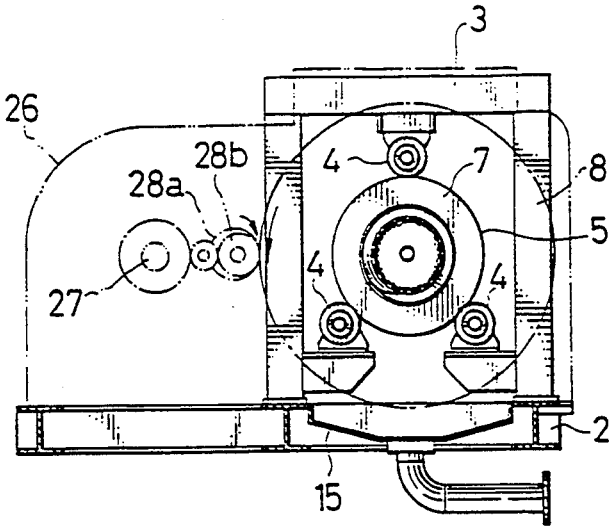
FIG. 5 is a cross-sectional view taken on line V—V of FIG. 1.

Referring to FIGS. 1 and 5, a screw press 1 according to the disclosed embodiment of this invention is mounted on a main support 2. As shown in FIG. 1 and FIG. 5, a frame 3 is secured to the main support 2. Three rollers 4 are disposed on two portions of the frame 3, respectively. Two of the three rollers 4 are disposed on the lower portion of the frame 3 and the other roller is disposed on the center of the upper portion of the frame. An outer screen casing 5, which is mainly made from a metal mesh, is reinforced and integrated with a plurality of rings 6. The outer screen casing 5 is supported horizontally by the rollers 4 through a pair of rings 7 at both ends of the outer screen casing. As illustrated in FIGS. 2 and 5, a driven gear 8 is disposed on the outer left end of the outer screen casing 5. On the other hand, as illustrated in FIGS. 1 and 3, the right end of the outer screen casing 5 is connected through a flange 9 with a hopper 10 which serves as a slurry supplying part. The hopper 10 has a rectangular cylindrical shape and is provided with a mesh basket 11 on the inside thereof. The mesh basket 11 has a lower portion having a semi-cylindrical shape at the position of elongating a lower semi-circle of the outer screen casing 5. A chute 13 is placed under the mesh basket 11.

The slurry added flocculant is supplied to the hopper 10 from the upper end thereof. Solid material produced by flocculating the slurry is supplied into the hopper without being destroyed because there is no pipe for supplying the slurry in the hopper 10. The solid material of the slurry is precipitated and the supernatant liquid thereof stays in the tipper part of the hopper 10. The supernatant liquid is lead through two drains 14 to the chute 13 mounted under the hopper 10, and then drained from a drain dish 15 which is disposed below the hopper and supported by the main support 2. The slurry at the bottom of the hopper 10 is filtered through a mesh 12 on the lower portion of the mesh basket 11. The filtrate is then drained to the drain dish 15 through the chute 13. Consequently, the solid material is mainly left on the bottom of the hopper 10 and the slurry-supplying part serves as a thickener.

A circular cone 18 is arranged coaxially inside the outer screen casing 5. A base end which is a taper portion of the circular cone 18 is positioned at the bottom portion of the hopper 10 and is protruded therefrom. The diameter of the circular cone 18 becomes larger toward the opposite end, so that the space between an outer surface of the circular cone 18 and the outer screen casing 5 becomes gradually narrower. Both ends of the circular cone 18 are rotatably supported by bearings 21 which are secured to the frame 3. A spiral wing 22 extends all along the length of the outer surface of the circular cone 18 to form a screw shaft 20.

A motor 25 (FIG. 2) is mounted on the main support 2 parallel with the outer screen casing 5. A driving shaft 27 of the motor 25 is provided with a transmission 26 comprising a plurality of pinions for engaging a driven gear 8. When rotating the driving axis 27 clockwise by driving the motor in FIG. 5, the pinion 28*a* (or 28*b*) of the transmission 26 rotates likewise. The pinion 28*a* or 28*b* is selected to engage with the driven gear 8 of the outer screen casing 5. As a result, the outer screen casing 5 rotates counterclockwise. Other pinions (not shown) than pinions 28*a*, 28*b* can also be selected and thereby the rotational speed of the outer screen casing 5 can be varied.

Because the pinion 28*a* or 28*b* rotates downwardly where that pinion engages with the driven gear 8, a downward force is produced to press the outer screen casing 5 downwardly. The two lower rollers 4 make the outer screen casing 5 stable against the above mentioned force, namely, those two rollers support the outer screen casing 5 steadily without decentering the screw shaft 20. The driving shaft 27 of the motor 25 further extends through the gear box 26 and is pivoted by a plurality of bearings 28 secured to the main support 2. A sprocket wheel 29 is mounted on the top :of the driving shaft 27.

A shaft 30 is arranged parallel to the driving axis 27 of the motor 25 and is supported rotatably by the other bearing 31 secured to the main support 2. A sprocket wheel 32 is secured to one end of the shaft 30 and the other end is rigidly secured to the screw shaft 20. The sprocket wheel 29 is secured to the driving axis of the motor 25 and the sprocket wheel 32 is secured to the shaft 30. A chain 33 extends around the sprocket wheel 29 and the sprocket wheel 32 to transfer the rotation of the motor 25 to the screw shaft 20. The screw shaft 20 rotates clockwise, that is, in the opposite rotational direction to the rotational direction of the outer screen casing 5. The motor 25 is controlled by a control board 35.

Figure 6:
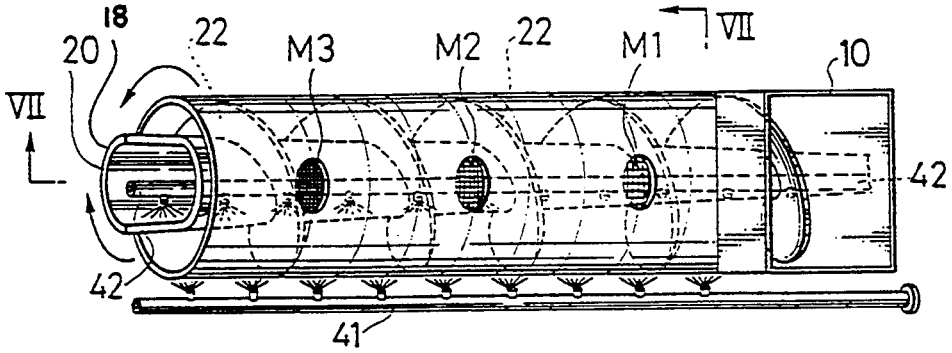
FIG. 6 is a perspective view showing a high pressure cleaning device for cleaning the outer screen casing and the screw shaft of the screw press, and the meshes of the outer screen casing.
Figure 7:
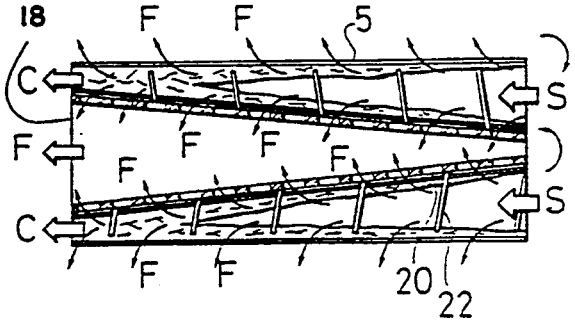
FIG. 7 is a cross sectional view taken on line VII—VII of FIG. 6 showing a double filter.

As illustrated in detail in FIGS. 6 and 7, the circular cone 18 is a hollow circular cone casing. The circular cone casing is in the form of a screen the same as the outer screen casing 5. As the spiral wing 22 extends to the bottom portion of the hopper 10, when the screw shaft 20 rotates, a slurry S moves immediately along the spiral wing 22 and is carried to the left side of the spiral wing. At the same time, the slurry S is pressed between the outer screen casing 5 and the circular cone 18, and the slurry is filtered by double filters formed by the outer screen casing 5 and the circular cone. A filtrate F drained outside the outer screen casing 5 drains down to the drain groove 15 to be drained. The filtrate F drained inside the circular cone 18 is drained through a drain 39.

The screens of the outer screen casing 5 and the circular cone 18 gradually become finer from the hopper 10 toward a drain exit 40 of a cake C. This is because the moisture content of the sludge becomes lower from the hopper toward the drain exit 40 of the cake C. An example of the screen of the outer screen casing 5 will be described as follows. The size of the mesh of the screen is set for three grades M1, M2 and M3 from the hopper side as shown in FIG. 6. M1 is a 2 mm-mesh screen with a numerical aperture of 40%. M2 is a 1 mm-mesh screen with a numerical aperture of 22.5%. M3 is a 0.5 mm-mesh screen with a numerical aperture of 18.6%.

Furthermore, if the size of the mesh of the screen in the circular cone 18 is smaller than that of the outer screen casing 5, it would be possible to have a superior water break to sludge including rich-fiber and to increase the quantity of sludge to be treated.

Cleaning pipes 41 and 42, which inject high pressure water, are disposed on the outer portion of the outer screen casing 5 and inside the screw shaft 20, respectively. These cleaning pipes 41 and 42 are connected to a water tank as described below. The high pressure water is force fed to the cleaning pipe 41 and 42 by a pump which is controlled by the control board 35.

The motor 25 serves as a drive unit which rotates the outer screen casing 5 and the screw shaft 20. The motor 25 can be overloaded when a cake is formed as the sludge comes to have high density content during processing the slurry, or when the screen is clogged. It is preferred to dispose a detector for detecting the overload as described below. As the overload is detected, it is possible to reduce the load by operating the control board 35 to make the motor 25 rotate backward to rotate the outer screen casing 5 and the screw shaft 20 in the opposite rotational direction to the initial rotational direction, respectively. The above mentioned backward rotation is to be performed for a predetermined period of time. By injecting high pressure water from the cleaning pipe 41 and 42, during the above mentioned time of the backward rotation, it is possible to clean all the screens of the outer screen casing 5, the screw shaft 20, all the contacting surface of the cake formed on the screen, and to further reduce the load of the drive unit 25.

The description now describes the effect of oppositely rotating the outer screen casing 5 relative to the screw shaft 20. Charts 1 and 3 attached to the end of the description indicate the results of the experiments of dehydrate processing the various kinds of slurry by using the screw press of the present invention (the screw press proved to be capable of also inhibiting outer screen casing 5 from being rotated).

Chart 1 shows a result of the experiment of dehydrate-processing slurry produced by flocculating a paper drainage. This experiment was performed by backwardly rotating the outer screen casing 5 and the screw shaft 20 by changing both rotational speeds N1 and N2 to equalize the difference N1−N2 (the sum of absolute value of their rotational speed) of both rotational speeds.

Chart 2 shows a result of the experiment of dehydrate-processing sludge produced by a sewerage disposal plant, This experiment was performed for one case that the outer screen casing 5 was fixed (the outer screen casing 5 having a rotational speed N2=0) and the screw shaft 20 was gradually revved up, and for the other case that rotational speed N2 (the backward rotation) of the outer screen casing 5 was gradually revved up relative to the screw shaft 20.

Chart 3 shows a result of the experiment of dehydrate-processing slurry which is produced by flocculating and depositing a paper drainage. This experiment was performed by gradually revving up (backward rotation) the outer screen casing 5 relative to the rotation of the screw shaft 20.

According to Chart 1, Test No. 1 was performed with the screw shaft 20 having a rotational speed N1 of 0.6 rpm. The outer screen casing 5 has a rotational speed N2 of −0.3 rpm, so as to have the difference of the rotational speeds N1−N2 of 0.9 rpm. Test No. 2 was performed with the screw shaft 20 having rotational speeds N1 of 0.9 rpm, the outer screen casing 5 having rotational speeds N2 of 0, that is, the outer screen casing 5 was fixed to set the difference of rotational speeds to be also 0.9 rpm. Although the differences of rotational speeds are the same 0.9 rpm, Test No. 1, by backwardly rotating the outer screen casing 5, resulted in 56.4% of the moisture content and 35.6 Kg-DS/hr of processing amount of the dry cake, and had higher processing effect in comparison with Test No. 2 by fixing the outer screen casing 5, resulting in 57.9% of the moisture content and 33.3 Kg-DS/hr of the processing amount of the dry cake. The same results could be obtained in Test No. 3 and No. 4, and No. 5 and No. 6.

In the test shown in Chart 2, when the outer screen casing 5 was fixed and the rotation of the screw shaft 20 was revved up, the moisture content and the processing amount became larger (Tests No. 7–9). On the other hand, when the rotational speed N1 of the screw shaft 20 was unchanged and the rotational speed N2 of the outer screen casing 5 was gradually revved up, the moisture content was almost constant but the processing amount was increased a great deal (Tests No. 10 and 11, No. 12 and 13, No. 14–16). However, when the rotational speed of the outer screen casing 5 becomes more than a certain degree relative to the screw shaft 20, an increasing rate of the moisture content became larger in comparison with that of the processing amount (Tests No. 15 and 16).

In the test shown in Chart 3, when the rotational speed (backward rotation) of the outer screen casing 5 revved up with fixed rotational speed of the screw shaft 20, the moisture content was almost unchanged but the processing amount increased (Tests No. 19 or 22). However, when the rotational ratio N2/N1 of the outer screen casing 5 to the screw shaft 20 was increased more than a certain degree, the moisture content becames larger (Tests No. 18 and 23).

Therefore, it is obvious that the dehydrating effect is increased by rotating the outer screen casing 5 in the opposite rotational direction to the rotational direction of the screw shaft 20. Furthermore, the rotational ratio N2/N1 of the rotational speed N2 of the outer screen casing 5 to the rotational speed N1 of the screw shaft 20 is preferably about 0.1 at the minimum and 0.8∼1.2 at the maximum. It will be understood that the driving force to the slurry is produced by the spiral wing 22 and friction force is produced between the slurry and an inner surface of a slurry chamber defined by the outer screen casing 5 and the screw shaft 20, and the driving force and the friction force multiply act on the slurry during backward rotation of the outer screen casing 5 at a low speed relative to the screw shaft 20 to rapidly move the slurry and to effectively dehydrate the slurry. It will be also understood, when further revving up the rotation of the outer screen casing 5, that the slurry slips on the inner surface of the slurry chamber to suppress the dehydrating effect and to increase the moisture content.

Figure 8:
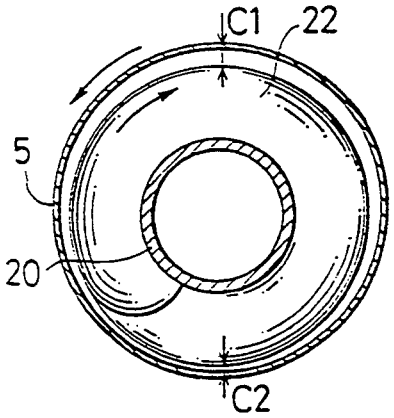
FIG. 8 is a cross sectional view showing the screw shaft decentering relative to the outer screen casing.

As to the other effect by backward rotation of the outer screen casing 5 against the screw shaft 20, it is possible to drain the cake having a uniform thickness and moisture content from the drain exit 40 even if the screw shaft 20 and the outer screen casing 5 are decentered or the spiral wing is partially abraded. FIG. 8 is a explanatory drawing of the effect, and shows the condition of the screw shaft 20 decentered relative to the outer screen casing 5. As long as the outer screen casing 5 is fixed, it is impossible to unify the cake since decentering points C1 and C2 are always placed on the same positions. However, if the outer screen casing 5 rotates backwardly, it is possible to unify the cake because of changing the positions of the decentering points C1 and C2.

Figure 9:
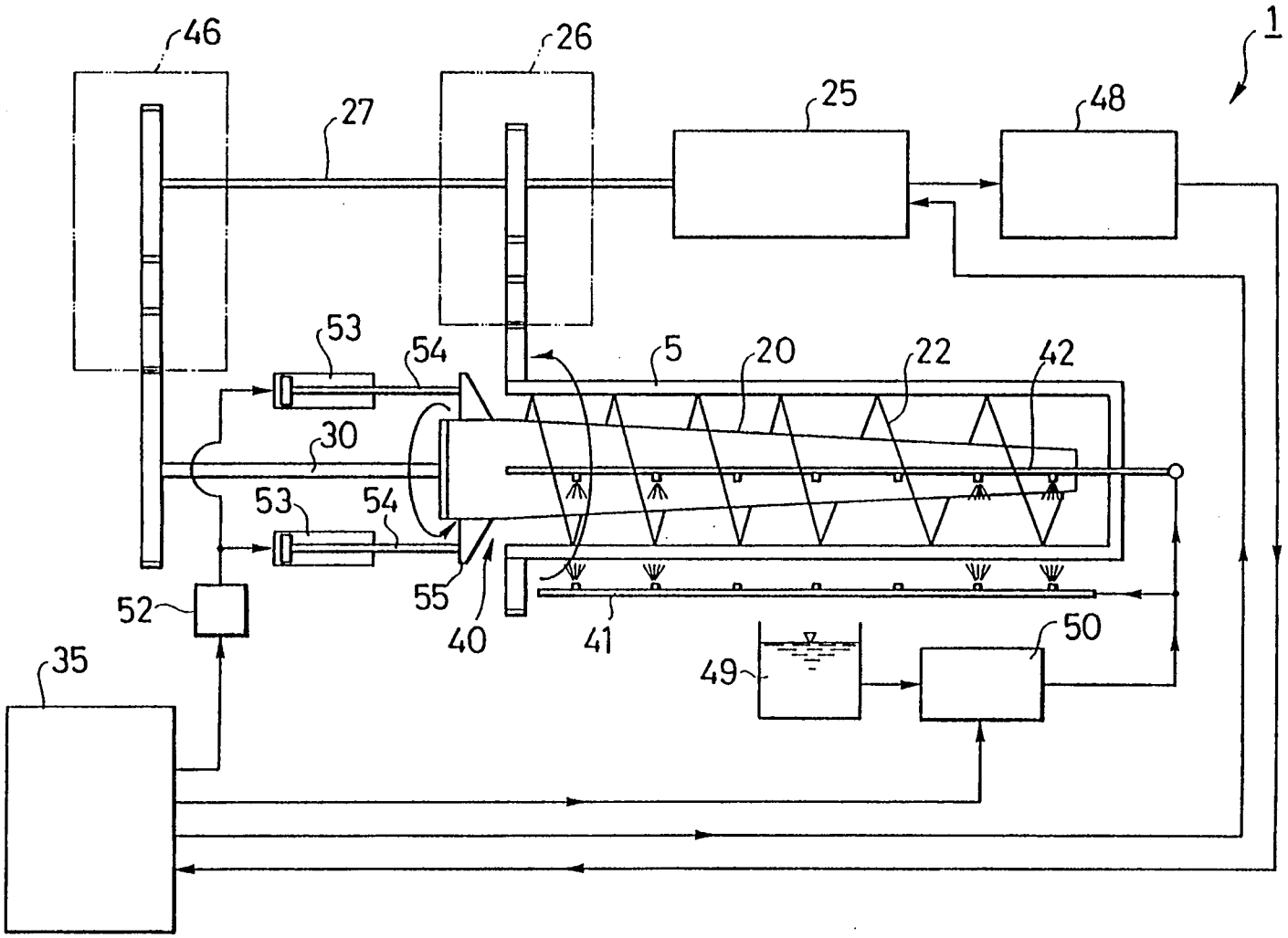
FIG. 9 is a diagram showing various driving units of the screw press of FIG. 1.

FIG. 9 shows various drive units each of which drives the above mentioned screw press. At the screw press of the above mentioned embodiment, the screw shaft 20 and the outer screen casing 5 are rotatably driven by the motor 25. A first transmission 25 is mounted only on a driving series of the outer screen casing 5 but not on a series of screw shaft 20. The diagram of the FIG. 9 shows a modified example of screw press having a second transmission 46 for shifting a gear on the driving series of the screw shaft 20 to be able to suitably change the rotational speed of the screw shaft 20. A load detector 48 for detecting the load is disposed on the motor 25.

The description will be made with regard to a method of driving the screw press 1 with reference to the Figures.

At first, the first and second transmissions are set for rotating the screw shaft 20 and the outer screen casing 5 at an appropriate rotational ratio, Then the motor 25 is driven by operating the control board 35 to rotates the screw shaft 20 in one direction and the outer screen casing 5 in the opposite direction. The screw shaft 20 is usually rotated at the speed of 1–10 rpm. Therefore, the slurry in the slurry supplying part (not shown) is transferred along the spiral wing 22 to be dehydrated and pressed. The formed cake is discharged from the drain exit 40. A ring 55 having a taper surface is disposed in the drain exit 40. The ring 55 is connected to a piston rod 54 having two hydraulic cylinders. The cylinders 53 are driven to operate as the control board 35 drives the oil pressure pump unit 52. Therefore, it is possible to set the position of the ring 55 by moving the ring right or left. It is possible to adjust the amount of draining of the cake and the amount of the pressure force pressing the cake by controlling the position of the ring 55.

When the pressed cake has a high viscosity or solidity and when the screens of the outer screen casing 5 and the screw shaft are clogged, the motor 25 suffers from overload and then the screw press does not work sufficiently. When the load of the motor 25 approaches a predetermined degree, the load detector 48 detects that load and transmits a signal to the control board 35. Upon receiving that signal, the control board 35 is operated manually or automatically to rotate the motor 25 backwardly for a period of time. Therefore, the screw shaft 20 and the outer screen casing 5 rotate in the opposite rotational directions to the present rotational directions, respectively, to reduce the load of the motor 25. When the motor 25 is operated to be rotated backwardly, the control board 35 automatically actuates the pump 50 for the above mentioned period of time to feed the water inside the water tank 49, connected to the pump, into the cleaning pipes 41 and 42 at high pressure. Accordingly, the high pressure water is injected from the cleaning pipes 41, 42 to clean the inner and outer surfaces of the outer screen casing 5 and the screw shaft 20 and the contact surface thereof. In other words, the screens of the outer screen casing 5 and the screw shaft, the connecting surfaces of the outer screen casing 5, the screw shaft 20 and the cake am cleaned to further reduce the rotational resistance on the contact surface, further reducing the load of the driving motor 25.

The present invention should not be limited to the above mentioned embodiments, and preferably should be capable of being modified. For instance, it is possible to mount the pinion 28*a* and the driven gear 8 of the outer screen casing 5 thereon without the transmission for the drive unit, and to set these gear ratios to the predetermined value, and the ratio of rotation of the screw shaft 20 and the outer screen casing 5 to a predetermined value.

Although, in the above embodiment, the outer screen casing 5 and the screw shaft 20 are driven by one drive unit 25, it is possible to dispose two drive units and drive the outer screen casing 5 and the screw shaft 20, respectively. It is further possible to dispose the transmission on one or both drive units to separately set the rotational speed of the outer screen casing 5 and the screw shaft 20, respectively.

It is also possible to dispose one drive unit as indicated in the above embodiment, and to dispose one transmission next to the drive unit wherein the transmission is capable of changing the rotational speed of either the outer screen casing 5 or the screw shaft 20 or both.

As an alternative to the transmission operated by a gear shift, transmissions operated by a pulley, sprocket wheel, or other known transmissions may be used.

In the above embodiment, the outer screen casing 5 is in shape of a cylinder and the screw shaft 20 is in the shape of a circular cone. As an alternative to the above, the outer screen casing 5 can be in the shape of a circular cone, and the screw shaft 20 can be in the shape of a cylinder or in other shapes as long as a relative space between them narrows in the direction of extending the screw shaft 20.

In the above embodiment, there are three grades in the size of the mesh of the screen and the numerical aperture, but the grades alternately may be two, four or more. It is also possible to set the size of the mesh and the numerical aperture gradually smaller in the direction of the screw shaft, without any steps.

The screw press of this invention, as described above, has an excellent capability of processing dehydration. Moreover, the screw press is capable of resolving an overload to continue dehydration when the press does not work sufficiently as a consequence of producing the overload. Furthermore, it is possible to utilize the screw press of this invention in other industries because the screen press of this invention can process various kinds of slurries.

CHART 1

| TEST No. | Rotational Speed of the Screw Shaft N1 (rpm) | Rotational Speed of the Outer Casing N2 (rpm) | Difference N2 − N1 | Moisture Content of Cake (%) | Amount of Processing Dry Cake |
|---|---|---|---|---|---|
| 1 | 0.60 | −0.30 | 0.90 | 56.4 | 35.6 |
| 2 | 0.90 | 0 | 0.90 | 57.9 | 33.3 |
| 3 | 0.90 | −0.45 | 1.35 | 56.6 | 38.0 |
| 4 | 1.35 | 0 | 1.35 | 60.1 | 37.3 |
| 5 | 1.20 | −0.60 | 1.80 | 60.2 | 54.4 |
| 6 | 1.80 | 0 | 1.80 | 61.8 | 50.4 |

CHART 2

| TEST No. | Rotational Speed of the Screw Shaft N1 (rpm) | Rotational Speed of the Outer Casing N2 (rpm) | Ratio N2/N1 | Moisture Content of Cake (%) | Amount of Processing Dry Cake |
|---|---|---|---|---|---|
| 7 | 0.380 | 0 | 0 | 82.1 | 4.7 |
| 8 | 0.446 | 0 | 0 | 82.5 | 5.3 |
| 9 | 0.558 | 0 | 0 | 83.1 | 7.8 |
| 10 | 0.255 | 0.101 | 0.40 | 82.0 | 4.5 |
| 11 | 0.255 | 0.202 | 0.79 | 81.0 | 5.7 |
| 12 | 0.380 | 0.085 | 0.22 | 82.3 | 5.7 |
| 13 | 0.350 | 0.174 | 0.46 | 81.3 | 7.4 |
| 14 | 0.446 | 0.085 | 0.19 | 81.8 | 7.2 |
| 15 | 0.446 | 0.223 | 0.50 | 81.8 | 9.1 |
| 16 | 0.446 | 0.347 | 0.78 | 83.0 | 9.4 |

CHART 3

| TEST No. | Rotational Speed of the Screw Shaft N1 (rpm) | Rotational Speed of the Outer Casing N2 (rpm) | Ratio N2/N1 | Moisture Content of Cake (%) | Amount of Processing Dry Cake |
|---|---|---|---|---|---|
| 17 | 0.558 | 0.438 | 0.78 | 53.9 | 27.7 |
| 18 | 0.558 | 0.893 | 1.60 | 60.7 | 24.8 |
| 19 | 1.010 | 0 | 0 | 51.9 | 22.6 |
| 20 | 1.010 | 0.202 | 0.20 | 52.4 | 26.2 |
| 21 | 1.010 | 0.438 | 0.43 | 54.5 | 28.2 |
| 22 | 1.010 | 0.695 | 0.69 | 55.6 | 30.2 |
| 23 | 1.010 | 0.893 | 0.89 | 63.1 | 29.2 |

We claim:

1. A screw press (1) comprising:

a main support (2);

a frame (3) secured to said main support (2);

an outer screen casing (5) rotatably supported by said frame (3) to extend horizontally above said main support (2), said outer screen casing having a slurry supplying side at a first end and a cake discharging side at a second end, said outer screen casing (5) having mesh screens (M1, M2, M3) with a finer mesh on said cake discharging side (40, M3) compared with a mesh on said slurry supplying side (10, M1);

a screw shaft (20) rotatably mounted on said main support (2) coaxially inside said outer screen casing (5) to extend horizontally above said main support (2) so as to gradually reduce a space between said screw shaft (20) and said outer screen casing (5) in the extending direction, said screw shaft (20) being provided with a spiral wing (22) arranged around an outer surface of said screw shaft (20) along its extending length so as to substantially contact with said outer screen casing (5), and said screw shaft (20) having an outer surface with a mesh screen of a finer size compared with said mesh screens of said outer casing (5);

a slurry supplying means (10, 11, 14) disposed at said first end of said outer screen casing (5) to supply a slurry into said space between said outer screen casing (5) and said screw shaft (20); and at least one rotating means (25) for rotating said screw shaft (20) in one rotational direction and said outer screen casing (5) in the opposite rotational direction.

2. A screw press as claimed in claim 1, wherein said one rotating means (25) simultaneously rotates said outer screen casing (5) and said screw shaft (20) in opposite directions from each other.

3. A screw press as claimed in claim 1, wherein said one rotating means (25) is operative to rotate said outer screen casing (5) at a ratio of between 0.1 to 1.2 the rotating speed of said screw shaft (20).

4. A screw press as claimed in claim 3, wherein said rotating means (25) includes a transmission (26, 46) for changing the rotational frequency of at least one of said outer screen casing (5) and said screw shaft (20).

5. A screw press as claimed in claim 1, further comprising a detector (48) for detecting a load on said rotating means (25), and further comprising a backward rotating unit (25, 35) responsible to said load detector for rotating at least one of said outer screen casing (5) and said screw shaft (20) in directions opposite from said directions produced by said rotating means, when said detected load is substantially a predetermined amount indicative of an overload on said rotating means.

6. A screw press claimed in claim 1, wherein said screw shaft (20) has a hollow shape and said outer surface is in the form of a mesh screen for discharging a separated supernatant liquid produced by expressing slurry.

7. A screw press as claimed in claim 1, further comprising high pressure cleaning devices (41, 42) disposed outside said outer screen casing (5) for cleaning said outer screen casing and inside said screw shaft (20) for cleaning said screw shaft.

8. A screw press as claimed in claims 1 or 7 wherein said slurry supplying means (10, 11, 14) includes means (11, 12, 14) for draining a separated supernatant liquid of said slurry supplied to said slurry supplying means to concentrate said slurry.

9. A screw press as claimed in claim 1, wherein said slurry supplying means (10, 11, 14) includes a vertical hopper (10), said hopper (10) having a bottom portion communicating with said first end of said outer screen casing (5), and said screw shaft (20) having an end portion extending below the bottom portion of the hopper.

* * * * *